US006672100B1

(12) United States Patent
Taira et al.

(10) Patent No.: US 6,672,100 B1
(45) Date of Patent: Jan. 6, 2004

(54) POROUS PART FOR REFRIGERATORS, AND METHOD OF PRODUCING THE SAME AND REFRIGERATOR

(75) Inventors: Shigeharu Taira, Kusatsu (JP); Atsushi Endou, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/149,058

(22) PCT Filed: Nov. 17, 2000

(86) PCT No.: PCT/JP00/08109

§ 371 (c)(1),
(2), (4) Date: Jun. 7, 2002

(87) PCT Pub. No.: WO01/42656

PCT Pub. Date: Jun. 14, 2001

(30) Foreign Application Priority Data

Dec. 7, 1999 (JP) ..... 11/347539
Feb. 4, 2000 (JP) ..... 2000-027685

(51) Int. Cl.[7] ..... F25B 43/02; F25B 1/00
(52) U.S. Cl. ..... 62/468; 62/84
(58) Field of Search ..... 62/468, 84

(56) References Cited

U.S. PATENT DOCUMENTS 6,299,424 B1 10/2001 Futagami et al.

FOREIGN PATENT DOCUMENTS

| | | |
|---|---|---|
| JP | 60-156991 A | 8/1985 |
| JP | 61-118582 A | 6/1986 |
| JP | 5-33093 A | 2/1993 |
| JP | 7-63220 | 3/1995 |
| JP | 9-32770 A | 2/1997 |
| JP | 11-236890 A | 8/1999 |
| JP | 2000-110724 A | 4/2000 |
| WO | 99/014511 | 3/1999 |

*Primary Examiner*—William C. Doerrler
*Assistant Examiner*—Mark Shulman
(74) *Attorney, Agent, or Firm*—Birch, Stewart, Kolasch & Birch, LLP

(57) ABSTRACT

In this porous part producing method, a head part (11A, 11B) in the interior of a compressor, which is a sintered part, is subjected at least to vacuum substitution or heat blow cleaning, whereby after oils causing contamination and/sludge, such as rust-preventive oil, in the head part (11A, 11B) in the interior of the compressor is discharged therefrom, the head part (11A, 11B) is immersed in alkyl benzene type oil serving as refrigerator oil. Thereby, deterioration-inducing substances in the head part (11A, 11B) in the interior of the compressor is replaced with the refrigerator oil; thus, it is possible to produce a porous part which will not bring about contamination and/or sludge even if used as a component for refrigerators for a long time.

6 Claims, 2 Drawing Sheets

POROUS PART FOR REFRIGERATORS, AND METHOD OF PRODUCING THE SAME AND REFRIGERATOR

TECHNICAL FIELD

This invention relates to a porous part for refrigerators, which is used as a component for a compressor, refrigerant piping, or the like. This invention also relates to a refrigerator having a material (e.g., a porous part) used as a component for a compressor, refrigerant piping, or the like.

BACKGROUND ART

A sintered part as a porous part is inexpensive. However, because oils such as a processing oil, a form-rolling oil, a cutting oil and so on are used when processing the sintered part, these oils are contained in large quantities in the sintered part after the processing.

DISCLOSURE OF THE INVENTION

When this sintered part is used, for example, as a component for a compressor of a refrigerator, repetition of operation/stop conditions causes variations in the pressure in the interior of the compressor. As a result, the oils such as the processing oil exude from the sintered part. Among these oils, rust-preventive oils, which are liable to deteriorate a refrigerator oil in a refrigerator, have a problem of easily causing contamination and/or sludge which are a cause of clogging. For that reason, it is conceivable to wash the sintered part with a cleaning device before it is incorporated into the refrigerator as a component thereof. However, since this requires new capital investment, there is a problem in that the cost increases.

An object of the present invention is to provide a porous part which can be used as a component for refrigerators without causing contamination or sludge, and thus can realize a reduction in cost and a long-term reliability, and also provide a method for producing the same and a refrigerator.

In order to achieve the above object, a porous part for refrigerators of the present invention is characterized in that a refrigerator oil is contained in the part.

In the present invention, the refrigerator oil is contained in the porous part. Thus, even if the porous part is used as a component of a compressor and/or piping of a refrigerator, contamination and sludge, which is a cause of oil deterioration and/or clogging, is prevented from occurring. A cutting oil, a form-rolling oil and/or a processing oil is permitted to be contained in the refrigerator oil.

In one embodiment, at least one of an alkyl benzene type oil and an ether type oil is contained.

In this embodiment, since the alkyl benzene or ether type oil, contained in the porous part, has a specific gravity smaller than that of R32 refrigerant, the oil does not sink in the R32 refrigerant. Therefore, the porous part in this embodiment is suited as a component of a refrigerator in which R32 refrigerant is used.

In a method of producing a porous part for refrigerators according to another aspect of the present invention, a porous part is placed in a vacuum and then immersed in a refrigerator oil so that the refrigerator oil is contained in the porous part.

In this method, placing the porous part in a vacuum allows rust-preventive oil or any other oil which would cause contamination and sludge to discharge from inside of the porous part. After discharging such oils from the porous part, the porous part is immersed in the refrigerator oil. Thereby, the deterioration-inducing substances are replaced with the refrigerator oil, thus it is possible to produce a porous part which will not bring about contamination or sludge even if used as a component of refrigerators for a long time.

A refrigerator according to one embodiment has a material containing a refrigerator oil.

In the refrigerator, a part of a compressor and/or a refrigerant piping, for example, is made of this material. By thus doing, contamination and sludge, which are cause of oil deterioration and/or clogging, is prevented from occurrence. Cutting oil, form-rolling oil and/or processing oil may be contained in the refrigerator oil.

In another embodiment, the refrigerator uses a refrigerant that contains R32 refrigerant at 40 wt % or more.

In this embodiment, because the refrigerant contains R32 at at least 40 wt %, it is possible to achieve an improvement in COP (coefficient of performance) by R32 refrigerant having a high refrigerating capacity.

In one embodiment of the refrigerator, at least one of ether type oil, ester type oil and alkyl benzene type oil is contained in the above material as the refrigerator oil.

Ether type oils and ester type oils have compatibility with HFC type refrigerants, while alkyl benzene type oils have compatibility with the ether type oils and the ester type oils. These refrigerator oils do not cause contamination or sludge which is a cause of oil deterioration and/or clogging. With the refrigerator having a material impregnated with such oil, it is possible to prevent the occurrence of contamination and sludge.

In particular, since the alkyl benzene type oil and the ether type oil have respective specific gravities smaller than that of R32 refrigerant, they do not sink in R32 refrigerant. Therefore, the alkyl benzene type oil and the ether type oil are suited for the case where R32 refrigerant is used.

In another embodiment, the refrigerator uses at least one porous material as the material impregnated with the refrigerator oil.

In this embodiment, the porous material is adopted as the impregnated material, and thus it is possible to make the impregnation amount of the refrigerator oil large. This can improve a preventive effect of the occurrence of sludge and contamination.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BEST MODE FOR CARRYING OUT THE INVENTION

First Embodiment

This invention will hereinafter be described in further detail by illustrated examples.

Referring to FIG. 2, a process for producing a sintered part for refrigerators as an embodiment of this invention will be described. In this production process, as shown in FIG. 2A and FIG. 2B, a head part 11A in the interior of a compressor, which is a sintered part already subjected to processing and forming after sintering, is placed in a vacuum so that rust-preventive oil that was included in large quantities into the head part 11A during the processing and forming process is extracted from the head part 11A. Then, the head part 11A to be placed in the interior of the compressor is immersed in an alkyl benzene oil serving as a refrigerator oil, whereby the alkyl benzene oil is contained in the head part 11A. FIGS. 2A and 2B show a plan view and a side view, respectively, of a rear head 11A serving as the head part disposed in the interior of the compressor.

As a result, the rust-preventive oil in the head part 11A, which is a deterioration-inducing substance, is replaced with the alkyl benzene oil as the refrigerator oil. Thus it is possible to produce a head part to be placed inside a compressor that will hardly bring about contamination or sludge even if used as a component of a refrigerator for a long time. In particular, it is possible to prevent clogging of capillaries and expansion valves and oil deterioration in an air conditioner in which an HFC type refrigerant is used, thus making it possible to secure long-term reliability.

Further, since the alkyl benzene type oil as the refrigerator oil contained in the head part 11A in the interior of the compressor has a specific gravity smaller than that of R32 refrigerant, it does not sink in the R32 refrigerant. Accordingly, the head part 11A is particularly suitable as a component of a refrigerator using the R32 refrigerant.

Figure 2A:
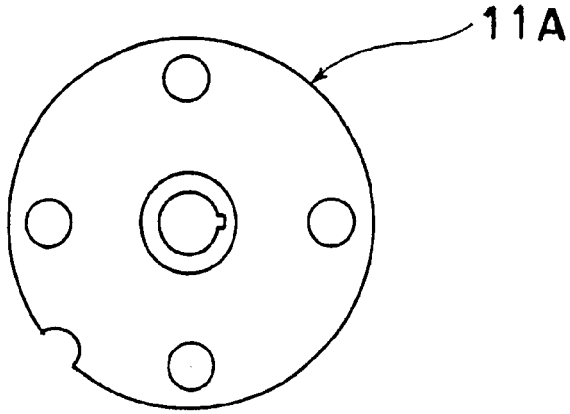
FIG. 2A is a plan view of a head part to be disposed in the interior of the refrigerator of the embodiment.
Figure 2B:
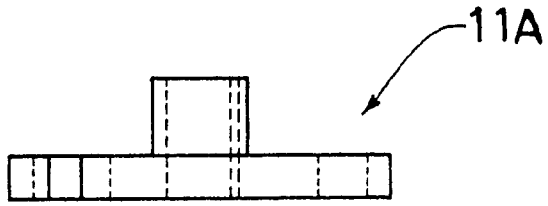
FIG. 2B is a side view of the head part.
Figure 2C:
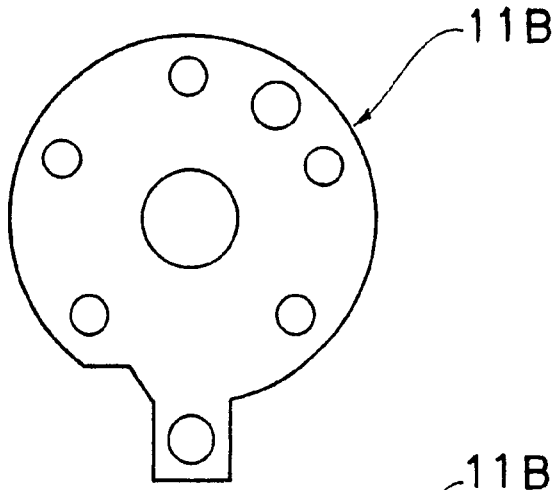
FIG. 2C is a plan view of a middle plate of the compressor.
Figure 2D:
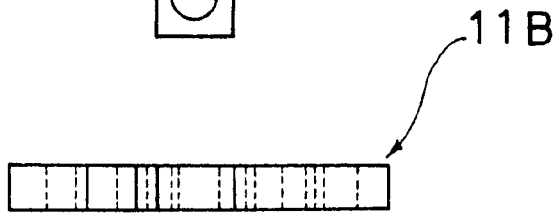
FIG. 2D is a side view of the middle plate.

Although in this embodiment, the rear head 11A, which is a head part in the interior of the compressor, is adopted as one example of components constituting a refrigerator to which the present invention is applied, a front head may also be adopted, and a middle plate 11B of the compressor as shown in FIG. 2C and FIG. 2D may also be adopted. Furthermore, the present invention is also applicable to components of, for example, a piston and/or refrigerant piping. Also, in the above embodiment, the head parts 11A, 11B, which are sintered parts serving as porous parts, contain an alkyl benzene type oil. Alternatively, they may contain a mixture of an alkyl benzene type oil and an ether type oil. Further, only an ether type oil may be used. In these cases as well, the specific gravity of the oil is smaller than that of the R32 refrigerant, thus making it possible to provide sintered parts suited as components of refrigerators.

Besides the alkyl benzene type oils and the ether type oils, the sintered parts may be impregnated with an ester type oil. Also, the sintered parts may be impregnated with a mixture of an ester type oil with either an alkyl benzene type oil or an ether type oil. Alternatively, the sintered parts may be impregnated with an oil containing benzene, a mixed oil of the oil containing benzene and an ester oil, or a mixed oil of the oil containing benzene and an ether oil. Furthermore, the sintered parts may be impregnated with new punching oil (an isoparaffinic refrigerator oil or an isoparaffinic oil).

In the above embodiment, the rust-preventive oil entering into the sintered parts when processed is let out under vacuum. Alternatively, the sintered parts may be impregnated with the refrigerator oil by using the refrigerator oil in place of the rust-preventive oil during the processing of the sintered parts. Further, although the porous parts in the above embodiment are sintered parts, the present invention can also be applied to porous parts formed of porous plastics or ceramics.

Second Embodiment

Figure 1:
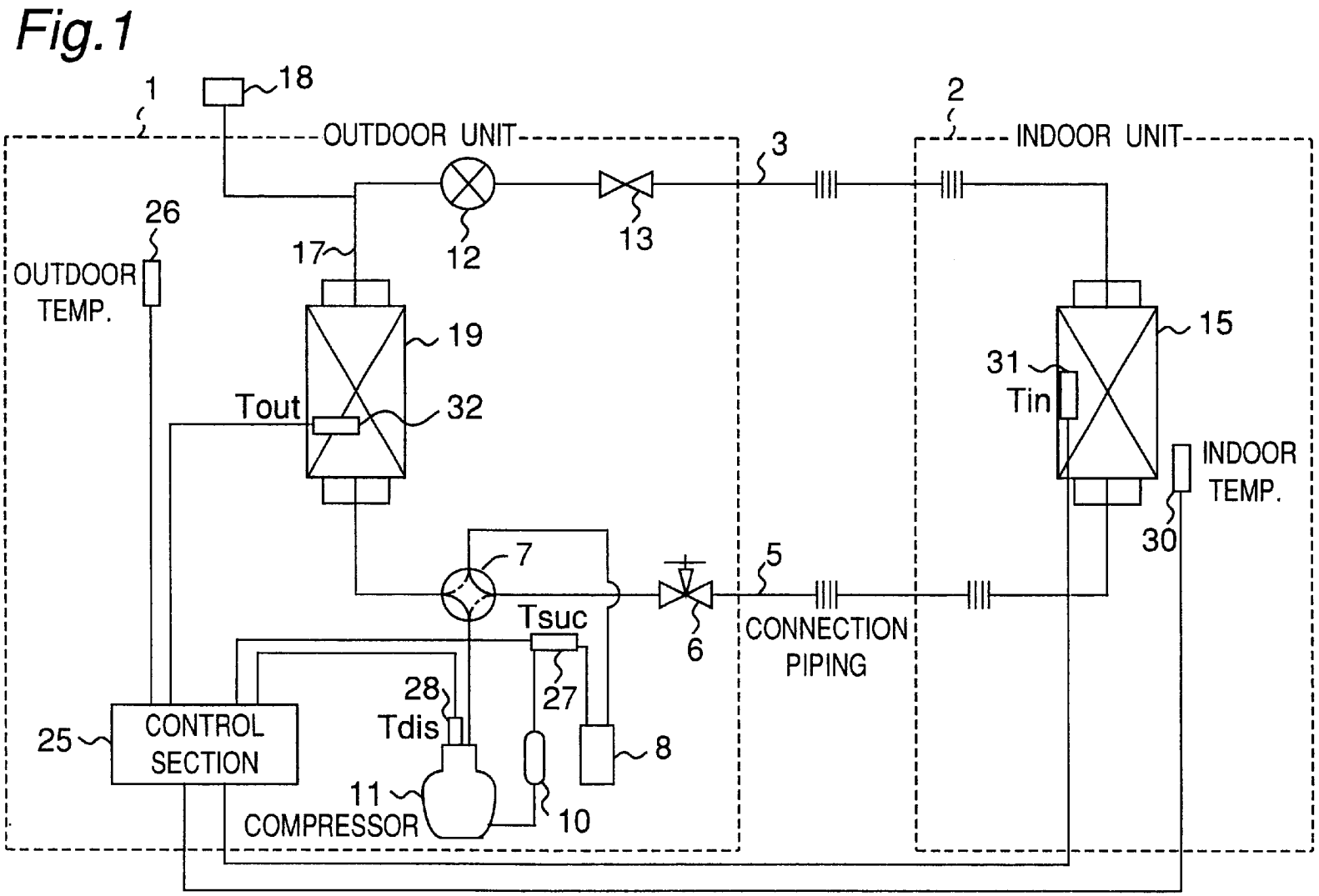
FIG. 1 is a refrigerant circuit diagram of an air conditioner as an embodiment of the refrigerator according to this invention.

Next, a refrigerant circuit of an air conditioner as an embodiment of the refrigerator of this invention is shown in FIG. 1. In this air conditioner, an outdoor unit 1 is connected via connecting pipings 3, 5 to an indoor unit 2. R32 refrigerant, which is slightly inflammable, is used as a refrigerant for the air conditioner.

In the outdoor unit 1, a valve 6 connected to the connecting piping 5, a four-way selector valve 7, a liquid-gas separator 8, an accumulator 10, a compressor 11, the four-way selector valve 7, an outdoor heat exchanger 19, a main expansion valve 12 and a valve 13 are connected in this order via refrigerant piping, and the valve 13 is connected to the connecting piping 3. On the other hand, the indoor unit 2 has a heat exchanger 15 connected to the connecting pipings 3 and 5.

A high-pressure relief valve 18 is connected to refrigerant piping 17 on the side of the expansion valve 12 of the outdoor heat exchanger 19. This high-pressure relief valve 18, which is arranged outside the outdoor unit 1, opens when the internal pressure of the refrigerant piping 17 exceeds a predetermined value, and it closes when the internal pressure thereof is lowered below the predetermined value.

The outdoor unit 1 is provided with a control unit 25 comprising a microcomputer. Connected to this control unit 25 are a temperature sensor 26 detecting the outdoor temperature, a temperature sensor 27 detecting the suction-side piping temperature $T_{suc}$ and a temperature sensor 28 detecting the discharge-side piping temperature $T_{dis}$ are connected. Further, a temperature sensor 30 detecting the indoor ambient temperature, a temperature sensor 31 detecting the temperature $T_{in}$ of the indoor heat exchanger 15 and a temperature sensor 32 detecting the temperature $T_{out}$ of the outdoor heat exchanger 11 are connected to the control unit 25. The control unit 25 having the above constitution controls the output of the compressor 11 and the degree of opening of the expansion valve 12 in response to temperature signals from those temperature sensors.

In this air conditioner, when heating, paths shown by dotted lines are selected by the four-way valve 7 of FIG. 1, so that the indoor heat exchanger 15 serves as a condenser, while the outdoor heat exchanger 19 serves as an evaporator. As a result, when heating, a line extending from the compressor 11, through the connecting piping 5, the indoor heat exchanger 15, and then the connecting piping 3, to the expansion valve 12 becomes a high-pressure line. On the other hand, when air-cooling, the four-way valve 7 of FIG. 1 selects paths shown by solid lines, so that the outdoor heat exchanger 19 serves as a condenser, while the indoor heat exchanger 15 serves as an evaporator. As a result, when air-cooling, a line from the compressor 11, through the outdoor heat exchanger 19, to the expansion valve 12 becomes a high-pressure line.

Next, a head part 11A of the compressor 11 is shown in FIG. 2A and FIG. 2B. This head part 11A is a rear head. The head part 11A was produced in the following manner. That is, a head part 11A, which is a sintered part already subjected to processing or working, and forming after sintering, is placed in a vacuum so that a rust-preventive oil that was included in large quantities into the head part 11A during the processing and forming process is extracted from the head part 11A. Then, the head part 11A is immersed in an alkyl benzene type oil serving as a refrigerator oil, whereby the alkyl benzene oil is contained in the head part 11A. FIGS. 2A and 2B show a plan view and a side view, respectively, of a rear head 11A serving as the head part.

As a result, the rust-preventive oil in the head part 11A, which is a deterioration-inducing substance, is replaced with the alkyl benzene type oil as the refrigerator oil. Thus the head part will hardly bring about contamination or sludge even if used as a component of a refrigerator for a long time. In particular, it is possible to prevent clogging of capillaries and expansion valves and oil deterioration in an air conditioner in which an HFC type refrigerant is used, thus making it possible to secure long-term reliability.

Further, since the alkyl benzene type oil as the refrigerator oil contained in the head part 11A of the compressor has a specific gravity smaller than that of the R32 refrigerant, it does not sink in the R32 refrigerant. Accordingly, the head part 11A is particularly suitable as a component of a refrigerator using the R32 refrigerant.

Although in this embodiment, the rear head 11A, which is one of head parts in the interior of the compressor, is adopted as one example of components constituting a refrigerator to which the present invention is applied, a front head may also be adopted, and a middle plate 11B of the compressor as shown in FIG. 2C and FIG. 2D may be adopted. Furthermore, another component such as a piston or refrigerant piping may also be adopted. Also, in the above embodiment, the head part 11A, which is a sintered part serving as a porous part, contains an alkyl benzene type oil. Alternatively, it may contain a mixture of an alkyl benzene type oil and an ether type oil. Further, only an ether type oil may be used. In these cases as well, the specific gravity of the oil is smaller than that of the R32 refrigerant, thus making it possible to provide a sintered part suited as a component of refrigerators using the R32 refrigerant. Use of the R32 refrigerant achieves a high COP value. The COP can be improved when using a refrigerant containing the R32 refrigerant at 40 wt % or more.

Besides the alkyl benzene type oils and the ether type oils, the sintered parts may be impregnated with an ester type oil. Also, the sintered parts may be impregnated with a mixed oil of an ester type oil with either an alkyl benzene type oil or an ether type oil. Alternatively, the sintered parts may be impregnated with an oil containing benzene, a mixed oil of the oil containing benzene and an ester oil, or a mixed oil of the oil containing benzene and an ether oil. Furthermore, the sintered parts may be impregnated with new punching oil (an isoparaffinic refrigerator oil or an isoparaffinic oil).

In the above embodiment, the rust-preventive oil entering into the sintered part when processed is let out under vacuum. Alternatively, the sintered part may be impregnated with the refrigerator oil by using the refrigerator oil in place of the rust-preventive oil during the processing of the sintered part. Further, although the porous part in the above embodiment is a sintered part, the porous part may also be formed of porous plastics or ceramics. Furthermore, making a material other than porous materials contain a refrigerator oil and using the material to constitute a part of a refrigerator also makes it possible to achieve the long-term reliability while preventing the occurrence of contamination and sludge, which is a cause of oil deterioration and clogging.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A porous part for use in refrigerators, wherein the porous part contains a refrigerator oil with which a rust-preventive oil has been replaced.

2. The porous part according to claim 1, wherein the refrigerator oil contained in the porous part is at least one of an alkyl benzene type oil and an ether type oil.

3. A method of producing a porous part for refrigerators, wherein a porous part (11A, 11B) is placed in a vacuum, and then the porous part (11A, 11B) is immersed in a refrigerator oil to be impregnated with the refrigerator oil.

4. A refrigerator using a HFC type refrigerant and an ether or ester type refrigerator oil, wherein the refrigerator has a material (11A, 11B) impregnated with an alkyl benzene type oil.

5. The refrigerator according to claim 4, wherein said HFC type refrigerant used in the refrigerator contains R32 refrigerant at 40 wt % or more.

6. The refrigerator according to claim 4, wherein at least one porous material serves as a material (11A, 11B) impregnated with the alkyl benzene type oil.

* * * * *